US005414922A

United States Patent [19]

Korb et al.

[11] Patent Number: 5,414,922

[45] Date of Patent: May 16, 1995

[54] PROCESS FOR PRODUCING A RIVETED JOINT BY FORMING A RIVET HEAD ONTO A HEATED RIVET PIN USING A RIVETING TOOL

[75] Inventors: Georg Korb, Reutte; Dieter Sporer, Tannheim, both of Austria

[73] Assignee: PM Hochtemperatur-Metall GmbH, Frankfurt am Main, Germany

[21] Appl. No.: 124,705

[22] Filed: Sep. 21, 1993

[30] Foreign Application Priority Data

Sep. 21, 1992 [DE] Germany ..... 42 31 508.5

[51] Int. Cl.[6] ..... B23P 11/00

[52] U.S. Cl. ..... 29/525.2; 411/501; 411/DIG. 2

[58] Field of Search ..... 29/524.1, 525.2, 243.53; 411/501, 900, DIG. 2; 470/28, 32

[56] References Cited

U.S. PATENT DOCUMENTS 1,934,780 11/1933 Van Halteren ..... 29/524.1

4,512,699 4/1985 Jackson et al. ..... 411/501

5,120,175 6/1992 Arbegast et al. ..... 29/524.1

FOREIGN PATENT DOCUMENTS 687165 1/1940 Germany .

OTHER PUBLICATIONS

Machinery, vol. 91, Nov. 15, 1957 at 1159.

*Primary Examiner*—Mark Rosenbaum
*Assistant Examiner*—David P. Bryant
*Attorney, Agent, or Firm*—Morgan & Finnegan

[57] ABSTRACT

The invention relates to a process for producing a riveted joint using a riveting tool. The essential feature is that a pin-shaped blank of a recrystallized, coarse-grained iron-based or nickel-based ODS superalloy having a grain elongation in the longitudinal direction of 5:1 to 50:1 is used for the rivets. The production of the rivet heads is performed under defined process temperatures, at a pin temperature between 600° and 1000° C. and at a tool temperature between 50° and 300° C.

9 Claims, 1 Drawing Sheet

PROCESS FOR PRODUCING A RIVETED JOINT BY FORMING A RIVET HEAD ONTO A HEATED RIVET PIN USING A RIVETING TOOL

FIELD OF THE INVENTION

The invention relates to a process for producing a riveted joint by forming a rivet head onto a heated rivet pin using a riveting tool.

BACKGROUND

By virtue of their outstanding mechanical properties at high temperatures, iron-based and nickel-based oxide dispersion strengthened (ODS) superalloys are used in particular for components which are subjected to high thermal and mechanical stresses. ODS superalloys extend the temperature operating range of heat-resistant materials up to about 1350° C. Problems arise with respect to the technique used for joining components of ODS superalloys to one another and to components of different materials. In the case of fusion-welded joints, a reduction in the strength of the weld down to 10% of the strength of the base metal must be accepted, whereas in the case of soldered joints the use of the material composite is limited by the melting temperature of the solder, which is generally lower than the usually possible operating temperature of ODS materials of up to about 1350° C.

In order to avoid problems of welded and soldered joints, as a further joining technique in the case of ODS materials, specifically in the case of sheet-metal constructions, use has also been made of riveted joints, but generally using rivets of a different type of material. The use of rivets of the same type of material has largely been avoided owing to a lack of suitable thermomechanical pretreatment and processing of the rivets, since there often occurred a loosening or a creeping of the rivets under load and temperature, which then resulted in failure of the component.

The US journal *Machinery,* Volume 91, Nov. 15, 1957, page 1159, and German Patent 687, 165 disclose riveting tools with the aid of which riveted joints can be produced by heating up rivet pins and by upsetting rivet heads. Neither of the two publications provide any suggestions of the use of ODS superalloys for the rivet pins or detailed process parameters for producing the riveted joint.

SUMMARY OF THE INVENTION

The object of the invention is to provide a process for producing a riveted joint for components, in particular of iron-based or nickel-based ODS superalloys, by the use of which the disadvantages of the previously known riveted joints can be eliminated with certainty.

This is achieved according to the invention by the rivet pin consisting of a recrystallized, coarse-crystalline iron-based or nickel-based ODS superalloy having a grain elongation in the longitudinal direction of 5:1 to 50:1 and by the shaping of the rivet head being performed under defined process temperatures at a pin temperature between 600° and 1000° C. and at a tool temperature between 50° and 300° C.

DETAILED DESCRIPTION OF THE INVENTION

Figure 1:
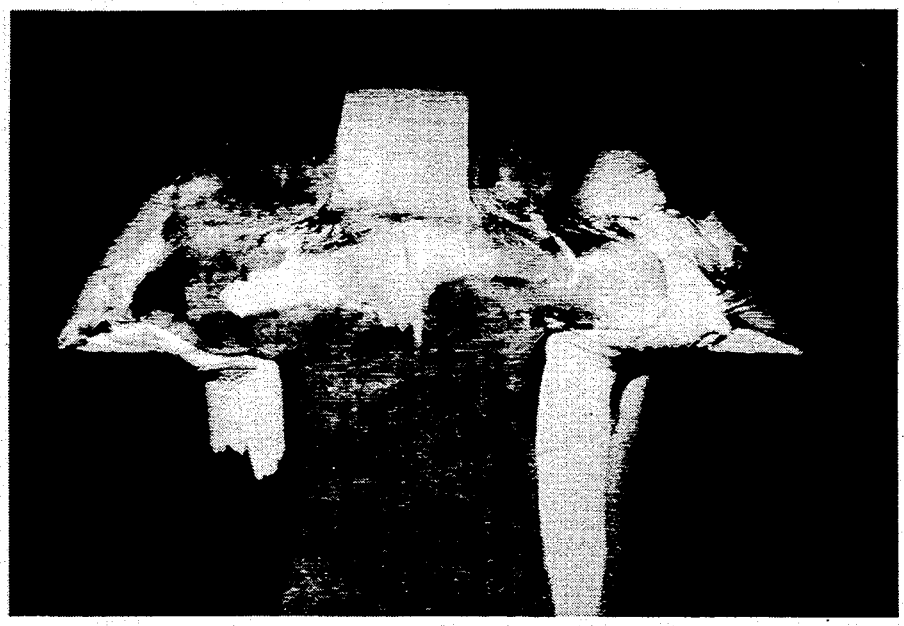
FIG. 1 shows the etched microsection of a rivet produced according to the invention as described under Example 1 (infra), magnified 16 times.

In this type of production, the finished rivet head in the riveted joint has a very advantageous coarse grain structure with extremely good heat and creep resistance, which essentially corresponds to that which can be established in a known way in the case of a semi-finished product of such materials and it is described in more detail further below in the examples. By maintaining the temperature essential for the invention when producing the rivet heads, the optimum coarse grain structure is virtually undisturbed, so that during the intended use of such component assemblies it is certain that no creeping of the rivets under load or any loosening of the riveted joint can occur at the usually high operating temperatures.

The process according to the invention has proved its worth in particular in the riveted joining of components of which at least one consists of an iron-based or nickel-based ODS superalloy. However, in principle it is suitable for joining all materials which can be riveted and are used at high temperatures.

It has proved to be particularly advantageous if the shaping of the rivet heads is performed at a pin temperature between 750° and 850° C. and a tool temperature between 200° and 300° C.

In addition, it is of advantage to match the pin volume intended for the shaping of the rivet heads to the respective pin temperature in such a way that a complete filling of the tool die is achieved during the shaping of the rivet heads.

This matching is particularly important since the iron-based and nickel-based ODS superalloys have a very highly temperature-dependent deformation behavior. As a result, depending on pin temperature, even if the pin volume intended for the shaping of the rivet heads corresponds exactly to the volume of the rivet heads, at low pin temperatures there is not complete filling of the tool die and consequently not an ideal configuration of the rivet head. In order to avoid this, the pin volume intended for the shaping of the rivet heads must be greater than the volume of the rivet head in a relation dependent on the pin temperature. On the other hand, it must not be too great, in order to avoid overfilling of the tool die and consequently again an unideal configuration of the rivet head. The exact matching of pin temperature and volume for the rivet heads is performed empirically.

The invention is explained in more detail below with reference to examples:

EXAMPLE 1

To produce the blank for a rivet joining metal sheets of an iron based ODS superalloy, a rod of the same ferritic ODS alloy of 50 mm diameter was hot-swaged in the fine-grained, transformed state down to a diameter of 4.6 mm. Thereafter, this coarse wire was drawn at 700° C. to form a wire of 3 mm diameter. This was cleaned, pickled and recrystallized to a coarse structure at 1350° C. for 30 minutes. This produced the coarse elongated grain structure typical of such materials with a corn elongation of 20: 1. By sand blasting, the surface oxide was removed. After cutting the wire to length, the rivet heads were upset at a wire temperature of 700°

C. using a profile tool heated to 200° C. For joining the metal sheets, the rivet was again heated to 700° C. and closed by a rivet head, formed by a tool profiled according to the shape of the rivet head heated to 200° C.

EXAMPLE 2

As a variation from Example 1, the blank for the rivet was swaged from a ferritic ODS alloy in rod form of 50 mm diameter in the fine-grained state by rotary swaging in a long forging machine at about 850° C. to a diameter of 20 mm, then swaged down to a diameter of 4.5 mm in further swaging stages at similar temperatures. This coarse wire was recrystallized at 1300° C. for 90 minutes and then ground centerlessly to a diameter of 3.85 mm. This blank had a grain elongation of about 5:1 to 8:1. The coarse grain formation was within the usual limits.

In the same way as in Example 1, the rivet was fabricated from the blank and the metal sheets were riveted.

EXAMPLE 3

Rivets were produced as described under Example 1, with the exception that the upsetting of the rivet heads were performed at a pin temperature of 400° C., that is below the temperature range according to the invention.

For comparison, microsections were prepared from the rivets produced as described under Example 1 and Example 2, the surface of the microsection was etched and the structure of the rivet heads was microscopically examined.

FIG. 1 shows the etched microsection of a rivet produced according to the invention as described under Example 1, magnified 16 times.

Figure 2:
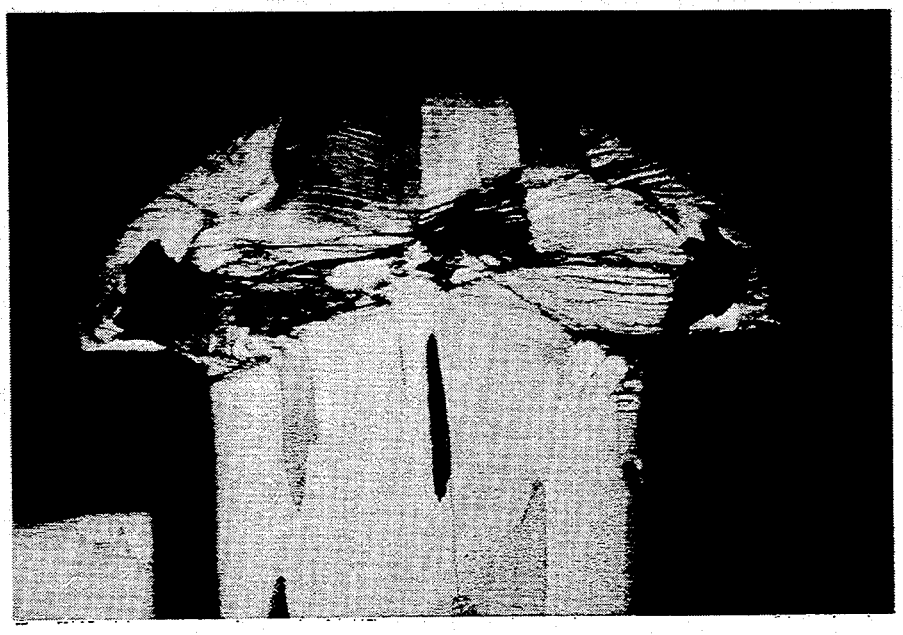
FIG. 2 shows the etched microsection of a rivet produced as described under Example 3 (infra), magnified 16 times.

FIG. 2 shows the etched microsection of a rivet produced as described under Example 3, likewise magnified 16 times.

It can be clearly seen that, in the case of the rivet head which was upset below the temperature according to the invention, the head is poorly shaped. In addition, it can be seen that there are a multiplicity of flow lines lying closely together and very unfavorably.

In the case of the rivet head which was upset at the temperature according to the invention, the head is optimally shaped. In addition, there are only a few, much more favorably distributed flow lines.

We claim:

1. A process for producing a riveted joint between a plurality of components, each component including a hole therethrough, said process comprising:

providing a rivet pin with a preformed head on one end thereof, said rivet pin consisting of a recrystallized, coarse-crystalline, iron-based or nickel-based oxide dispersion strengthened superalloy having grain elongation in the longitudinal direction in the range of 5:1 to 50:1;

orienting said components such that the holes in the components are axially aligned;

inserting said headed rivet pin through said aligned holes such that a portion of said pin opposite said one end projects from said aligned holes;

heating said rivet pin to a temperature between 600 and 1000 degrees C.;

heating a riveting tool to a temperature between 50 and 300 degrees C.;

shaping said projecting portion of said heated rivet pin with said heated riveting tool to form a deformed rivet head, thereby capturing said components between said preformed head and said deformed head.

2. A process for producing a riveted joint as claimed in claim 1, wherein at least one of said components consists of an iron-based or nickel-based oxide dispersion strengthened superalloy.

3. A process for producing a riveted joint as claimed in claim 2, wherein the shaping of the projecting portion of the heated rivet pin is performed at a pin temperature between 750 and 850 degrees C.

4. The process for producing a riveted joint as claimed in claim 3, wherein the tool temperature is between 200 and 300 degrees C.

5. The process for producing a riveted joint as claimed in claim 2, wherein the tool temperature is between 200 and 300 degrees C.

6. A process for producing a riveted joint as claimed in claim 1, wherein the shaping of the projecting portion of the heated rivet pin is performed at a pin temperature between 750 and 850 degrees C.

7. The process for producing a riveted joint as claimed in claim 6, wherein the tool temperature is between 200 and 300 degrees C.

8. The process for producing a riveted joint as claimed in claim 1, wherein the tool temperature is between 200 and 300 degrees C.

9. The process for providing a rivet joint as claimed in claim 1, wherein said rivet pin with said preformed head is formed from said superalloy having a pinshape, by heating said pinshaped superalloy to a temperature between 600 and 1000 degrees C., heating a riveting tool to a temperature between 50 and 300 degrees C. and shaping one end of said heated pinshaped superalloy with said heated riveting tool to form said preformed head.

* * * * *